US006578638B2

(12) United States Patent
Guillory et al.

(10) Patent No.: US 6,578,638 B2
(45) **Date of Patent: *Jun. 17, 2003**

(54) DRILLABLE INFLATABLE PACKER & METHODS OF USE

(75) Inventors: Brett Guillory, The Woodlands, TX (US); David Ward, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/940,067

(22) Filed: Aug. 27, 2001

(65) Prior Publication Data

US 2003/0037932 A1 Feb. 27, 2003

(51) Int. Cl.[7] ..... E21B 33/12

(52) U.S. Cl. ..... 166/387; 166/123; 166/131; 166/181; 166/184; 166/187; 175/230

(58) Field of Search ..... 166/387, 123, 166/131, 181, 182, 184, 187, 117.6; 175/61, 81, 230

(56) References Cited

U.S. PATENT DOCUMENTS

| | | | | |
|---|---|---|---|---|
| 3,948,322 A | | 4/1976 | Baker | 166/289 |
| 4,372,562 A | | 2/1983 | Carter, Jr. | 277/34 |
| 4,951,747 A | | 8/1990 | Coronado | 166/187 |
| 4,979,570 A | * | 12/1990 | Mody | 166/387 |
| 5,133,412 A | | 7/1992 | Coronado | 166/381 |
| 5,458,194 A | | 10/1995 | Brooks | 166/285 |
| 5,469,919 A | | 11/1995 | Carisella | 166/387 |
| 6,009,951 A | * | 1/2000 | Coronado et al. | 166/387 |
| 6,213,217 B1 | * | 4/2001 | Wilson et al. | 166/387 |
| 6,269,878 B1 | | 8/2001 | Wyatt et al. | 166/142 |

FOREIGN PATENT DOCUMENTS

| | | | |
|---|---|---|---|
| EP | 0 528 327 | 8/1992 | E21B/33/127 |
| EP | 0 733 775 | 3/1996 | E21B/7/06 |

OTHER PUBLICATIONS

PCT Written Opinion from PCT/GB00/03831, Dated Jul. 13, 2001.

PCT International Search Report, International Application No. PCT/GB 02/03860, dated Nov. 29, 2002.

* cited by examiner

*Primary Examiner*—David Bagnell
*Assistant Examiner*—Zakiya Walker
(74) *Attorney, Agent, or Firm*—Moser, Patterson & Sheridan, L.L.P.

(57) ABSTRACT

Methods for reclaiming a borehole extending from an earth surface into the earth, part of which borehole is in a lost circulation zone. The methods include the steps of closing off the borehole to fluid flow above the lost circulation zone by installing a packer system with an inflatable packer element, inflating the inflatable packer element with cement, allowing the cement to set so that the inflatable packer effectively seals off the borehole to fluid flow, and then drilling out the inflatable packer. Such a method also may include a further operation conducted in the borehole within the lost circulation zone. The packer system comprises in one arrangement a packer body, an inflatable bladder around the packer body, a plurality of ribs mounted around at least a portion of the inflatable bladder, and a valve apparatus, all of which are fabricated from a drillable material.

24 Claims, 8 Drawing Sheets

DRILLABLE INFLATABLE PACKER & METHODS OF USE

BACKGROUND OF THE INVENTION

1. Field of the Invention

This invention is directed to inflatable packers used in wellbore operations, to methods of using them and, in certain particular aspects, to drillable inflatable packers, methods of using them, and cementing methods using such packers.

2. Description of the Related Art

In many wellbore operations an inflatable packer is positioned in a wellbore and retrieved (e.g. but not limited to oil well wellbores, gas well wellbores, and bores in coal beds). It can be difficult to drill or mill conventional packers which have various hard metal parts. This can be a serious problem, particularly if a retrievable inflatable packer cannot be retrieved and must be drilled through or milled out. In drilling various wells, e.g. geothermal wells, it is common to encounter lost circulation zones that absorb drilling fluids. Prior to resuming normal drilling operations, lost circulation zones are plugged off. In one prior art plugging method, a retrievable packer is set above the zone, and cement is pumped through the packer and into the zone. If pumped cement flows in channels in the formation, routes around and above the packer, and sets, retrieval of the packer may not be possible. In certain prior art methods a non-retrievable packer and related apparatus are used so that, following successful plugging of a lost circulation zone, further wellbore operations conducted through the non-retrievable packer are limited by the restricted diameter of bores through the non-retrievable packer and related apparatus.

There has long been a need for an efficient packer which can be used effectively in a bore or borehole during wellbore operations, including but not limited to cementing operations. There has long been a need, recognized by the present inventors, for such a packer that can be drilled out or milled out rather than retrieved so that the entire diameter of a borehole can be reclaimed for subsequent operations. There has long been a need for such a packer and methods of its use for effectively

SUMMARY OF THE INVENTION

The present invention, in certain embodiments, provides a drillable inflatable packer and methods of its use. The present invention, in certain embodiments, provides a cementing method using such a packer and an associated packer setting and inflation system.

In one aspect a system according to the present invention includes a selectively settable drillable inflatable packer and a running system with a valve assembly for controlling flow to the packer and to other parts of the system and a lower valve through which cement is flowable into the annulus outside the system and below the packer. Initially fluid (e.g., but not limited to, water, brine, or cement) is pumped through the system and the valve assembly into the packer. Following proper inflation of the packer to seal off the annulus in the borehole between the system's exterior and the borehole's interior, and following setting of the cement, fluid (e.g., but not limited to cement, brine, or water) is pumped through the system, through the packer, through the lower valve and into the formation to plug it off for further operations, e.g., but not limited to, drilling operations or operations above and/or below the lost circulation zone.

Upon completion of the plugging operations, the running system is disengaged from the packer (and from associated apparatus) and the running system is then removed from the borehole, leaving the drillable inflated packer in place. Optionally, the borehole can then be reclaimed for operations below the packer by cutting through (e.g. by drilling or milling) the packer, cement, and lower valve apparatus.

In certain aspects, the present invention provides an inflatable packer with a packer body, an inflatable bladder mounted around the packer body, and a plurality of ribs mounted around the inflatable bladder. The packer body, the inflatable bladder, and the ribs may be made of drillable material. A lower valve apparatus used with the packer may also be made of drillable material.

In certain aspects, the present invention provides a method for reclaiming a borehole extending from an earth surface into the earth, part of which is in a lost circulation zone, the method including closing off the borehole to fluid flow above the lost circulation zone by installing a packer system with an inflatable packer element and a valve apparatus in the borehole above the lost circulation zone, inflating the inflatable packer element with cement, and allowing the cement to set so that the inflatable packer and the valve apparatus effectively seal off the borehole to fluid flow.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide new, useful, unique, efficient, nonobvious drillable, inflatable packers and methods of their use;

Such a packer useful in well operations, including, but not limited to, cementing operations;

Such a packer that is easily drilled through or milled out from the borehole, in one aspect, so that the entire diameter of the borehole is reclaimed without an area limited by the restricted diameter of other wellbore apparatus;

Such a packer useful in operations for plugging off a lost circulation zone;

Such a packer that is effective in open hole operations or within a tubular, e.g. in cased hole operations;

Such a packer useful in a cementing operation having a lower valve apparatus that can be selectively opened, cemented through, and selectively closed so that pressure is held both above and below it; and Such a packer useful in operations in oil wells, gas wells, water wells, and bores in coal beds.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

BRIEF DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DETAILED DESCRIPTION OF THE PREFERRED EMBODIMENT

Figure 1A:
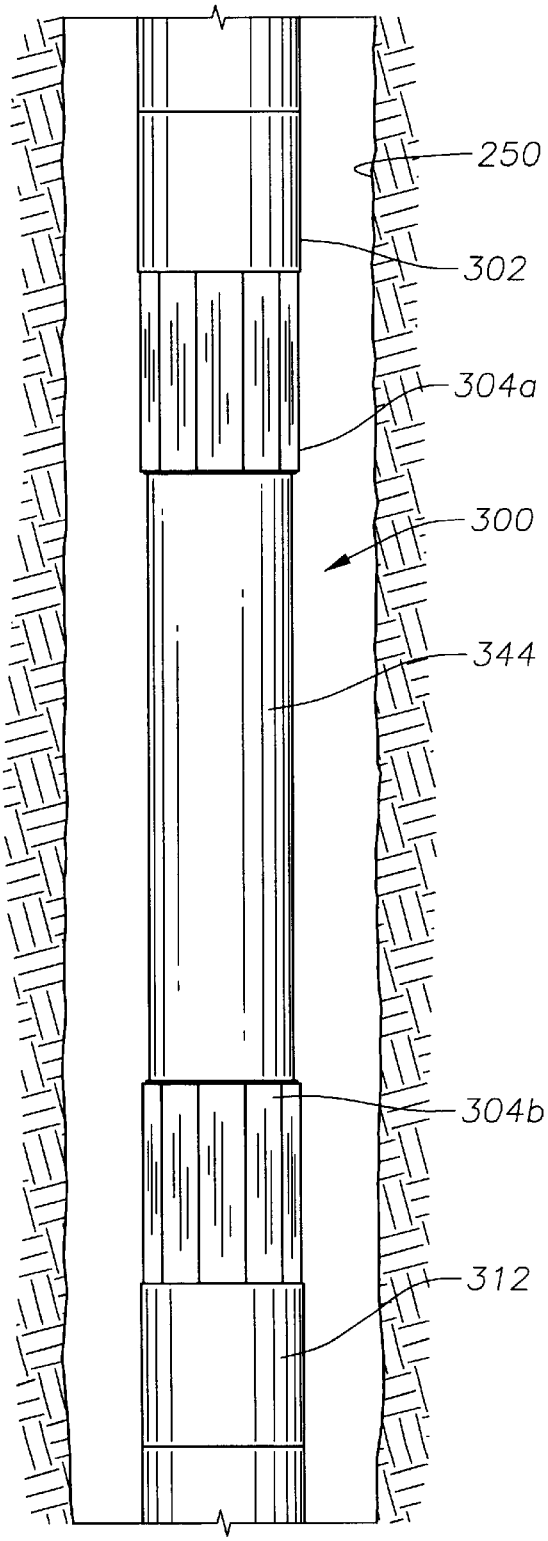
FIG. 1A is a side schematic view of one embodiment of a packer of the present invention prior to inflation of the packer.

FIG. 1A is a side schematic view of one embodiment of a packer 300 of the present invention disposed in an uncased wellbore 250 prior to inflation of the packer. For ease and clarity of illustration and description, the packer 300 will be further described in more detail as if disposed in a vertical position in the wellbore 250. It is to be understood, however, that the packer 300 may be disposed in any orientation, whether vertical or horizontal. Furthermore, the packer 300 may be disposed in any tubular hole, such as within a wellbore with casing there-around or within a tubular. Typically, the packer is run into a wellbore on a string of tubulars and includes at an upper end a connection means. In some instances, the packer may include at a lower end a connection means for the connection of other down-hole tools and/or tubulars.

The packer 300 of the present invention comprises an upper sleeve adapter 302, a lower sleeve adapter 312, an inflatable bladder 344, and a plurality of ribs 304. The inflatable bladder 344 is adapted to be inflated with a fluid, such as cement, brine, or water. In one embodiment, as shown in FIG. 1A, the ribs 304 may be "discontinuous" along the inflatable bladder 344. For example, the upper sleeve adapter 302 may be configured to retain a first set of ribs 304*a* between the upper sleeve adapter 302 and a top portion of the inflatable bladder 344. The lower sleeve adapter 312 may be configured to retain a second set of ribs 304*b* between the lower sleeve adapter 312 and a bottom portion of the inflatable bladder 344. In another embodiment (not shown), the ribs may be "continuous" along the inflatable bladder 344 in which one set of ribs are retained by both the upper sleeve adapter 302 and the lower sleeve adapter 312. In one embodiment, the ribs are "discontinuous" along the inflatable bladder 344 to allow greater expansion of the inflatable bladder 344 between the first set of ribs 304*a* and the second set of ribs 304*b*.

The ribs 304, whether continuous or discontinuous, may be arranged as one or more layers around the inflatable bladder. In one embodiment, the ribs may be arranged as one to fifty layers around the inflatable bladder.

In one embodiment, each rib 304 is rectangular in shape. Alternatively, the ribs 304 may be in other shapes or may be in a variety of shapes. For example, the ribs 304 may be in a shape that is at least partially curved, such as shaped like fingers, and/or may be in a shape that is at least partially pointed.

Figure 1B:
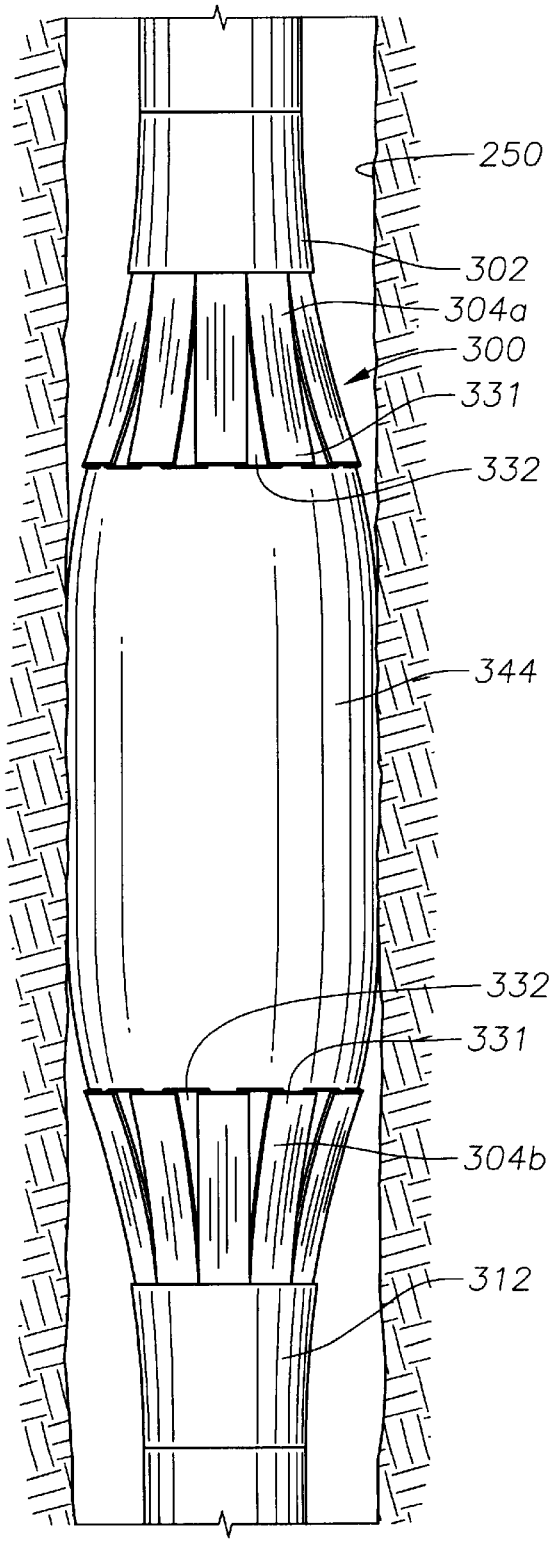
FIG. 1B is a side schematic view of the packer of FIG. 1A after inflation of the packer.

FIG. 1B shows a side schematic view of the packer 300 of FIG. 1A after inflation of the packer. In one aspect, as the inflatable bladder 344 is inflated with fluid, the ribs 304 bend to allow expansion of the inflatable bladder 344 while providing support for the shape of the inflatable bladder 344. The support provided by the ribs 304 helps prevent extrusion of the inflatable bladder 344 and bursting of the inflatable bladder 344.

The ribs 304 may be arranged around the inflatable bladder 344 in any pattern. For example, a layer of ribs may be arranged in which each rib in the layer does not overlap another rib in the same layer. In another embodiment, a layer of ribs may be arranged in which each rib partially overlaps another rib in the same layer. In one embodiment, if a plurality of layers of ribs are used, the layers are arranged around the inflatable to minimize or to eliminate exposure of the inflatable bladder between the ribs during inflation. For example, as shown in FIG. 1B, a first layer of ribs 331 may be at least partially offset from a second layer of ribs 332.

In one embodiment, as shown in FIG. 1B, the upper sleeve adapter 302 and the lower sleeve adapter 312 may also bend as the inflatable bladder 344 is inflated with fluid. In another embodiment (not shown), the upper sleeve adapter and the lower sleeve adapter may be rigid to the expansion of the inflatable bladder.

The ribs 304 may comprise any suitable material, e.g., but not limited to metals and metal alloys (steel, bronze, brass, stainless steel, aluminum, copper, tin, and other ferrous and non-ferrous metals); and, in certain aspects, to drillable materials, e.g. but not limited to aluminum, aluminum alloys, zinc, zinc alloys, cast iron, brass, bronze, copper, tin, other non-ferrous metals and non-ferrous metal alloys, fiberglass, PEEK, drillable plastic, PTFE, composite materials, composite-coated fiberglass, resin-coated fiberglass, cermet coated fiberglass and/or fiber reinforced resin materials. Composite materials include fiberglass, polymers, polymer blends, hydrocarbon-based materials and other structural materials, and may include strengthening members, such as glass fibers, carbon fibers, aramid fibers and/or other fibers, embedded in the material. Preferably, the ribs 304 comprise a composite material. In one embodiment, the ribs 304 comprise a composite material in which the ribs have a thickness between about 0.005 inches to about 0.100 inches.

In one embodiment, the packer 300 comprises a permanent set packer, such as a cement inflatable packer. The permanent set packer preferably comprises ribs 304 made of a drillable material to allow ease of reclaiming the bore for further operations after the packer has been set. For example, a packer 300 comprising ribs 304 made of a drillable material may be removed by drilling and/or milling through the packer 300 and drillable ribs 304.

Figure 2:
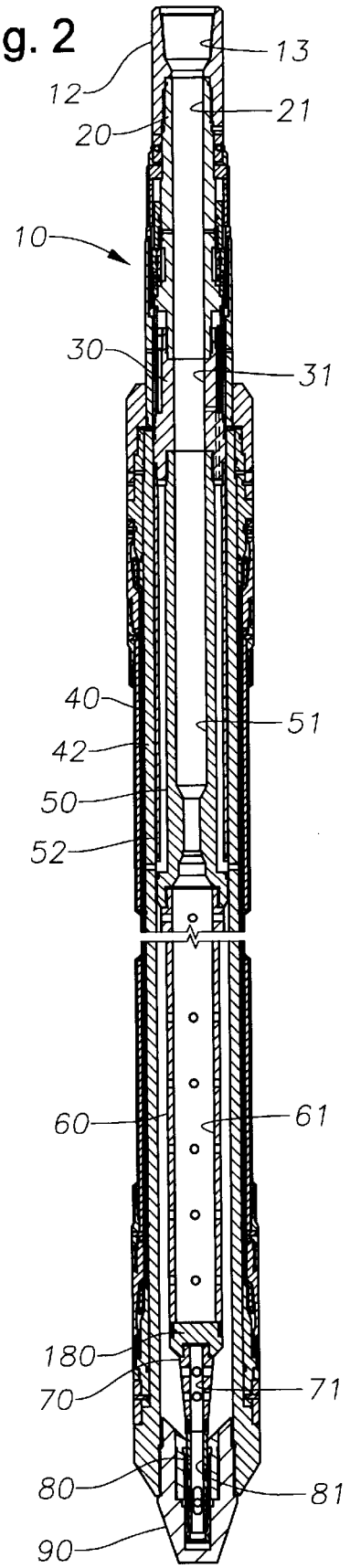
FIG. 2 is a side cross-section view of a system according to the present invention with a packer according to the present invention.
Figure 3:
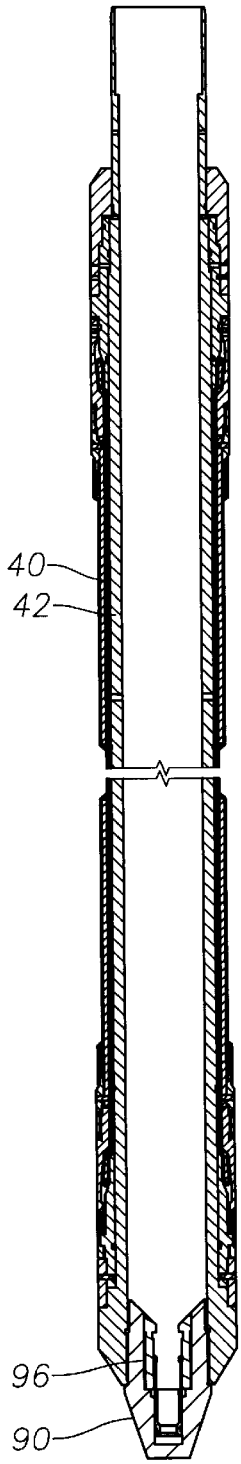
FIG. 3 is a side cross-section view of a packer according to the present invention and associated apparatus.

FIG. 2 shows a schematic cross-section view of one embodiment of a system 10 including a packer of the present invention. The system 10 according to the present invention has a top sub or crossover sub 12 to which is threadedly connected a mandrel 20. A lower end of the mandrel 20 is threadedly connected to a top end of a valve sub 30. Threadedly connected within a lower end of the valve sub 30 is a top end of a dart seat member 50. A dart seat sleeve 52 is sealingly held between the exterior of the dart seat member 50 and the interior of a packer mandrel 42. Any piece of the system 10 made of drillable material may be initially made as a single integral piece or a base piece (e.g. made of plastic fiberglass, etc.), may have portions on it that are built-up, e.g. by applying additional fiberglass, plastic, etc. With pieces made of e.g. fiberglass, for areas which will encounter relatively higher stresses, additional amounts of fiberglass may be applied. Fiber orientation may be selected to enhance strength.

A top end of a dart catcher 60 is threadedly connected to a lower end of the dart seat member 50. A top end of a crossover 180 is threadedly connected to a lower end of the dart catcher 60. A top end of a flow diverter 70 is threadedly connected to a lower end of the crossover 180. A lower end of the flow diverter 70 is threadedly connected to a top end of a stinger 80 whose lower end extends into a lower valve assembly 90. The top sub 12, mandrel 20, valve sub 30, dart seat member 50, dart catcher 60, flow diverter 70 and stinger 80 are generally cylindrical hollow members each, respectively, with top-to-bottom flow bores 13, 21, 31, 51, 61, 71 and 81; and the bore 13 is in fluid communication with the bore 21; the bore 21 in fluid communication with the bore 31; the bore 31 in fluid communication with the bore 51; and the bore 51 in fluid communication with the bore 61. The bore 71 of the flow diverter 70 is in fluid communication with the bore 81 of the stinger 80.

Figure 2A:
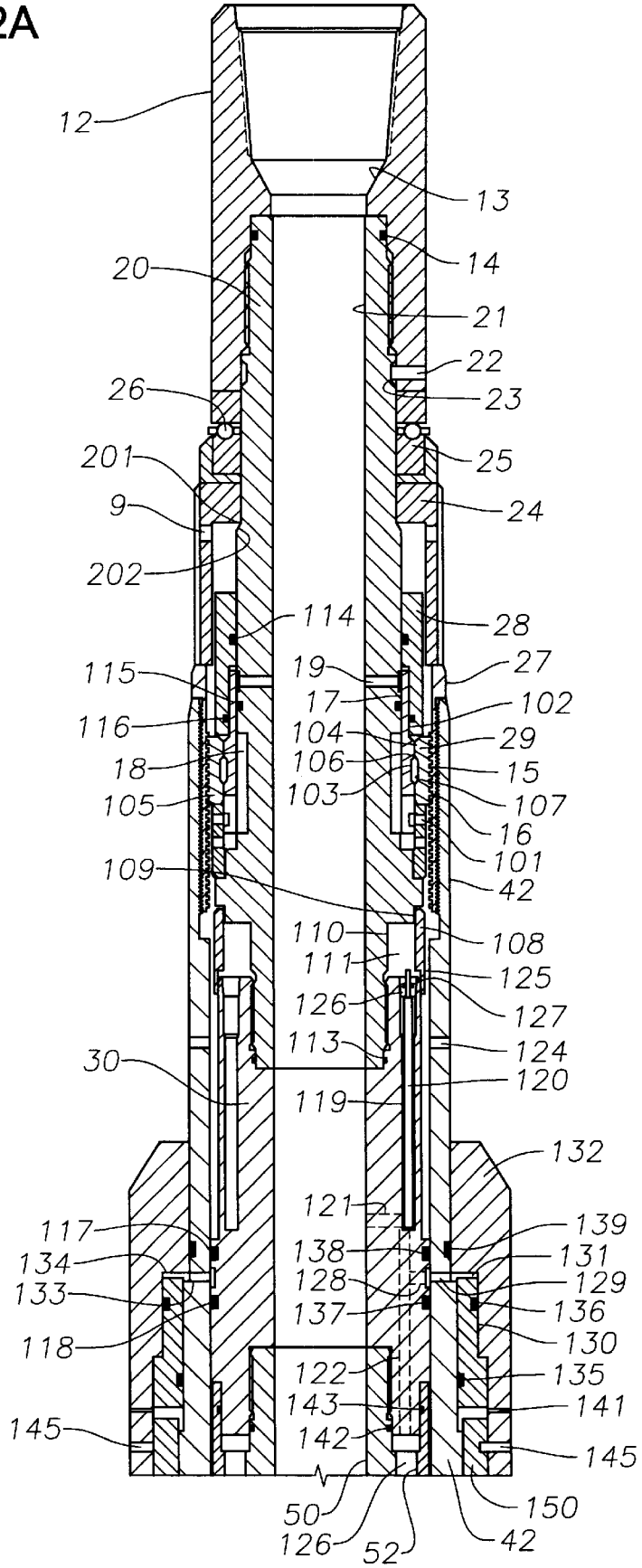
FIGS. 2A–2E are enlargements of parts of the system of FIG. 2.

Referring now to FIG. 2A, an O-ring 14 seals a top sub/mandrel interface. Set screws 22 (one shown) extend through the top sub 12 and into recesses 23 in the mandrel 20 to hold the top sub 12 and mandrel 20 together and prevent their un-threading with respect to each other.

Mounted on a bearing retainer 24 is a bearing assembly 25 extending around the mandrel 20 with multiple balls 26. Everything above the balls 26 and everything connected to and below the mandrel 20 can rotate on the balls 26 with respect to the packer 40. As described below, this permits the "running" apparatus to be rotatively disengaged from the "packer" apparatus to remove the running apparatus from a wellbore while leaving the packer apparatus in position in the wellbore. As described below, movement of dogs 29 can also effect separation of the running apparatus from the packer apparatus. The bearing retainer 24 has a top end 201 that abuts a shoulder 202 of the mandrel 20 to hold the bearing retainer 24 on the mandrel 20. A port hole 9 through the bearing retainer 24 permits pressure equalization between the outside and inside of the bearing retainer 24. The bearing retainer 24 may be made of drillable material, including, but not limited to, aluminum.

A lower end of the bearing retainer 24 rests on a top end of a thread bustling 27 and is secured to a packer mandrel 42. A dog retainer 28 disposed between the mandrel 20 and the bearing retainer 24 maintains the position of a plurality of movable dogs 29, each of which has an exteriorly threaded surface 15 that threadedly engages an interiorly threaded surface (shown at 16 in FIG. 2B) of the thread bushing 27. There are six movable dogs 29 (one shown) spaced apart around the generally cylindrical body of the mandrel 20.

Figure 2B:
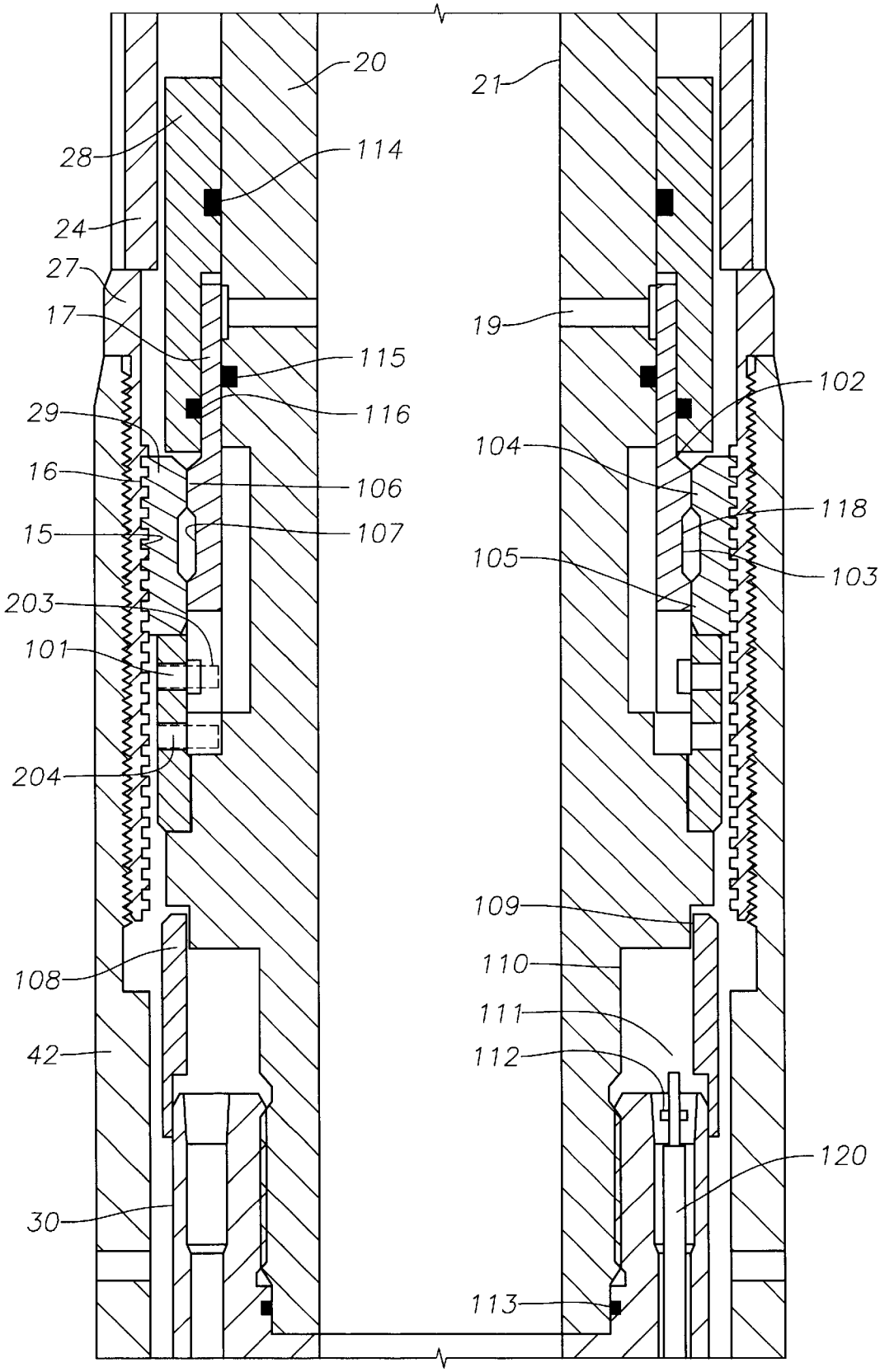

As shown more fully in the enlarged view of FIG. 2B, a piston 17 is movably disposed in a space 18 and fluid flowing through a port 19 of sufficient pressure, (e.g. about 2000 psi) pushes down on the piston 17 to shear screws 101 (four shear screws 101 may be used, spaced apart 90° around the system) to permit the piston to move downwardly with respect to the mandrel 20. A plurality of spaced apart set screws 203 connects together the dog retainer 28 and the mandrel 20. One such set screw 203 is shown in dotted line in FIG. 2B to indicate that it has a vertical position at a level similar to that of the shear screws 101, but the set screws 203 are also spaced apart from the shear screws 101 and spaced so that the lower end of a piston 17 will abut the set screws 203 to limit its downward movement for correct positioning and alignment with respect to the dogs 29. The set screws prevent rotation of the piston 17 and dogs 29 with respect to the mandrel 20. An O-ring 116 seals a piston/dog retainer interface and an O-ring 115 seals a piston/mandrel interface. A piston 114 seals a dog retainer/mandrel interface. Upon such downward movement of the piston 17, recess 102, 103 of the piston 17 align with projections 104, 105 of the dogs 29, and projection 106 of the piston 17 aligns with recesses 107 of the dogs 29, freeing the dogs 29 for inward movement, thereby freeing the running apparatus from the packer apparatus as described below (without the need for rotating the running apparatus with respect to the packer apparatus to separate the two). A port 204 in a lower end of the retainer 28 provides for the exit of fluid from a space between the mandrel 20 and the retainer 28 as the piston 17 moves downwardly therein.

The thread bushing 27 is externally threaded to threadedly mate with internal threads of a packer mandrel 42. The packer mandrel 42 (and any or all other parts of the packer apparatus and lower valve apparatus) may be made of any suitable material, e.g., but not limited to metals and metal alloys (steel, bronze, brass, stainless steel, aluminum, copper, tin, and other ferrous and non-ferrous metals); and, in certain aspects, to drillable materials, e.g. but not limited to aluminum, aluminum alloys, zinc, zinc alloys, cast iron, brass, bronze, copper, tin, other non-ferrous metals and non-ferrous metal alloys, fiberglass, PEEK, drillable plastic, PTFE, composite, composite-coated fiberglass, resin-coated fiberglass, cermet coated fiberglass and/or fiber reinforced resin materials. Composite materials include fiberglass, polymers, polymer blends, hydrocarbon-based materials and other structural materials, and may include strengthening members, such as glass fibers, carbon fibers, aramid fibers and/or other fibers, embedded in the material.

A pin retainer 108 is positioned between an interior surface of the packer mandrel 42 and exterior surfaces 109, 110 of the mandrel 20 to close off a space 111 into which a pin 112, or part(s) thereof, may move (as described below).

As shown in FIG. 2A, threadedly engaged with a lower end of the mandrel 20 is a top end of the valve sub 30. An O-ring 113 seals a mandrel/valve sub interface and O-rings 117, 118 seal a valve sub/packer mandrel interface. A valve assembly 120 (shown schematically) is housed in a channel 119 of the valve sub 30. Any suitable known valve assembly for inflatable packers may be used for the valve assembly 120, including but not limited to a valve assembly as disclosed in U.S. Pat. No. 4,711,301 and U.S. Pat. No. 4,653,588, each of which is hereby incorporated by reference to the extent not inconsistent with the present invention.

A port 121 provides fluid communication between the mandrel bore 21 and the valve assembly 120. A port 122 provides fluid communication between the valve assembly 120 and a channel 126 between an exterior of the dart seat member 50 and an interior of a dart seat sleeve 52. A port 124 provides for pressure equalization between the interior and exterior of the packer mandrel 42. A port 128 provides fluid communication between the valve assembly 120, via port 122, and a port 129 through the packer mandrel 42 which itself is in fluid communication with a space 131 in which is movably disposed a piston 130.

In those embodiments in which a shaft of the valve assembly 120 contacts a shaft 125 shear pinned to the valve sub 30 (or shear pinned to an insert in a recess 126 in the valve sub 30) by a shear pin 127, parts off the shear pin 127 may move out into the space 111 in which they are retained by the pin retainer 108.

An exterior of the piston 130 faces a piston housing 132 secured at its upper end to an exterior of the packer mandrel 42. A shoulder 133 of the piston 130 abuts a shoulder 134 of the piston housing 132 to limit upward movement off the piston 130 in the space 131. O-rings 135, 136, 137, 138, 139 seal the interfaces at which they are positioned. A hole 141 equalizes pressure between the exterior and the interior of the piston housing 132 and in the space 131 below the piston 130 in the position of FIG. 2C. The dart seat sleeve 52 prevents cement from contacting the interior of the packer mandrel 42. Such cement could inhibit separation of the dart seat member 50 (and the running apparatus) from the packer mandrel 42.

An O-ring 142 seals a dart seat_member/valve sub interface and an O-ring 143 seals a dart seat sleeve/valve sub interface.

Figure 2C:
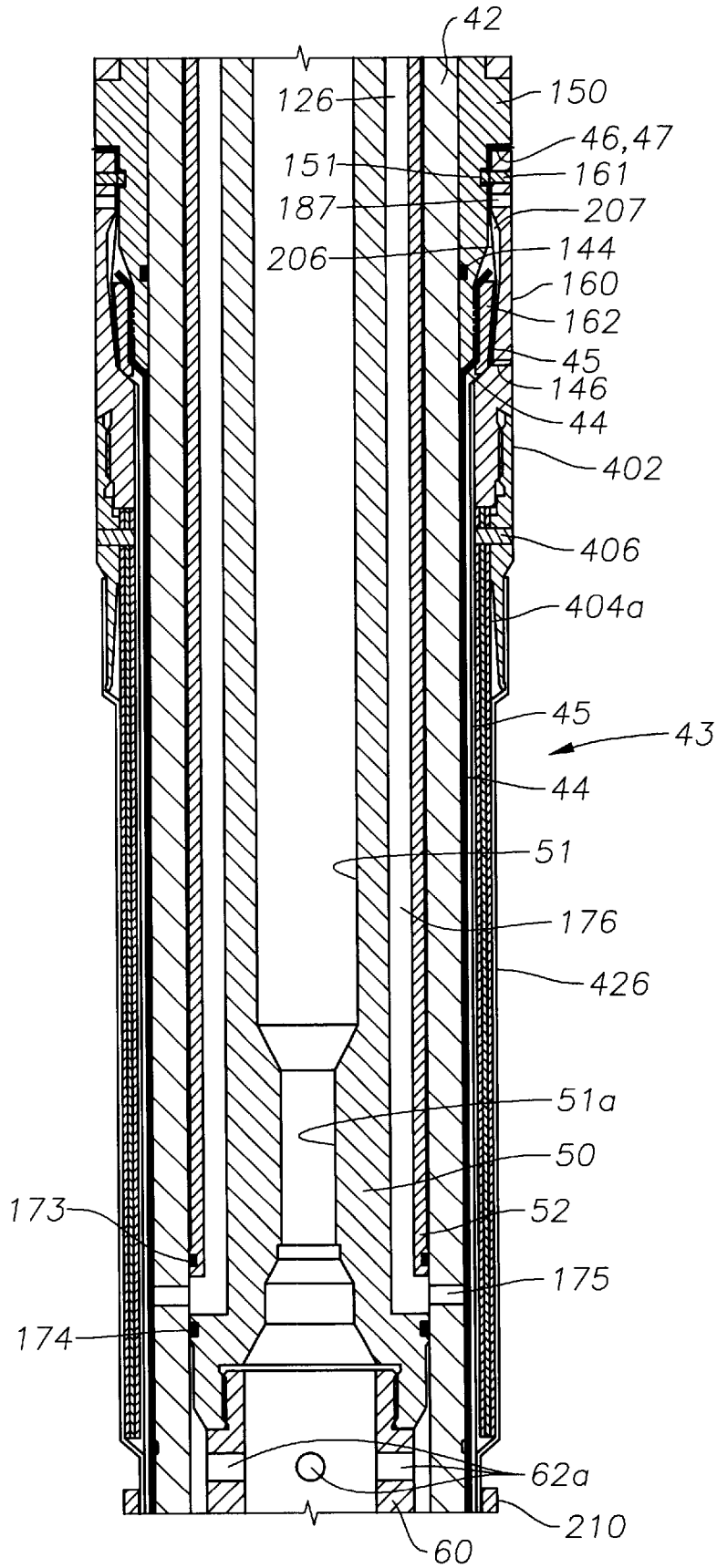

As shown in FIG. 2C, an upper element draw sleeve 150 is disposed exteriorly of the packer mandrel 42 and may be made of any of the same materials and/or "drillable' materials as used for the packer mandrel 42. An O-ring 144 seals a sleeve/packer mandrel interface. Shear pins (e.g. made of metal or fiberglass) 145 (FIG. 2A) extending through the piston housing 132 (FIG. 2A) and into the sleeve 150 releasably holds the sleeve 150 to the piston housing 132, thus initially preventing movement of the sleeve 150 with respect to the packer mandrel 42. Once the sleeve 150 is freed for movement, the bladder and bladder support are sufficiently freed to permit outward expansion in response to inflation fluid.

Mounted exteriorly of the sleeve 150 is a packer element 43 which may be any suitable packer element. In certain embodiments according to the present invention, the packer element 43 includes an inflatable bladder 44 and a bladder support 45. Top ends of the bladder support and bladder 46, 47 extend up between the sleeve 150 and a transition member 160 and a pin 161 through the transition member 160 pushes against the end 46 and projects into a recess 151 of the sleeve 150 to maintain the position of the bladder and bladder support. Holes 146 are bleed holes for epoxy that is used to glue together the transition member 160, bladder 44 and bladder support 45. Epoxy is injected through the port 187 which fills void areas between the transition member 160 and the draw sleeve 150. Optionally, recesses 206 in the sleeve 150 and/or 207 in the transition member 160 may be shaped so that hardened epoxy therein, which upon hardening is secured to the end of the packer element, creates a solid with a wedge shape that assists in maintaining correct position of the packer element.

A compression ring 162 disposed between the transition member 160 and the sleeve 150, and between the bladder 44 and the bladder support 45, forces the bladder 45 sealingly against a lower end of the sleeve 150. Optionally, the exterior of the lower end of the sleeve 150 and the interior of the compression ring 162 may have an undulation shape, as shown, to enhance the holding and sealing of the bladder 44.

Figure 2D:
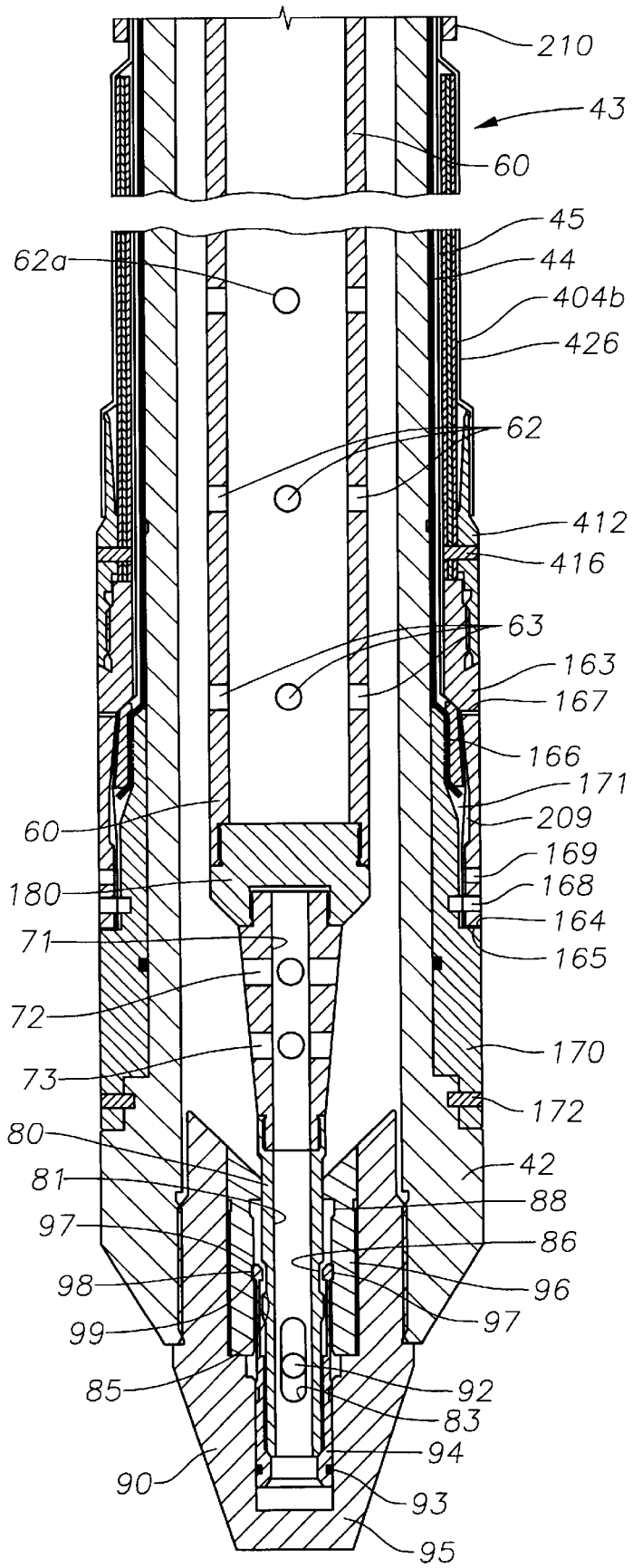

As shown in FIG. 2D, the bladder support 45, in certain aspects, is a flexible fabric made, e.g., of fabric material of sufficient strength to effectively support the bladder 44 during inflation and while it is in use in a wellbore. In certain embodiments the flexible fabric is made of material including, but not limited to, fiberglass, plastic, PTFE, rubber, and/or Kevlar ™ material. Any suitable fabric may be produced as a woven or air-laid fabric with fibers bonded together or not. Preferably the material expands to accommodate bladder inflation and, in certain aspects, retracts to correspond to bladder deflation. In one particular aspect, two layers or "socks" of a braided or woven fiberglass fabric are used for the bladder support 45 (e.g., in one particular aspect, fiberglass braid strands at 45° to each other to provide for expansion and contraction). In one aspect, only one such "sock" or layer may be used and, in other aspects, three or more such "socks" are used. In one particular aspect instead of the bladder/bladder support combinations described above, a fabric of suitable strength and elasticity, e.g. one or more of the "socks" described above has a rubber, rubber-like, or elastomer coating applied thereto so that it can serve as both bladder and bladder support. In one aspect such an element is made by first expanding a sock, then applying the rubber, rubber-like, or elastomer material so that future expansion of the braided material does not result in a rupture of the material containing the inflating fluid.

In another aspect, any sock(s) or element described above also has an expandable cover or sheath thereover to inhibit snagging of the sock(s) or element on an item in a bore as the system is passing through the bore. For example, as shown in FIG. 2C, a retaining member 210 releasably maintains the bladder support (and bladder) in position until the bladder is expanded. One or more retaining members (or bands) like the member 210 may be used or a cover or sheath over substantially all of the packer element may be used. In certain aspects the member 210 is made of drillable material and is sized and configured to break or tear upon expansion of the bladder. In one particular embodiment, rather than using a movable member to accommodate bladder expansion (e.g. as the movable draw sleeve 150) (or in addition to such a movable member) a sock or socks are used with one or more folds therein which, when unfolded, allow for bladder expansion. The fold or folds may be initially held against the packer mandrel by one or more bands (e.g. of rubber, elastomer, or fiberglass) and/or by a cover or sheath as described above. Folds can be oriented vertically, horizontally and/or at an angle.

The bladder 44 and bladder support 45 extend down the outside of the packer mandrel 42 to a lower mounting structure. The lower mounting structure is similar to the upper mounting structure. A transition member 163 has an upper end outside the packing element 43 and packer mandrel 42 and a lower end 164 pushing against lower ends of the bladder 44, bladder support 45 and a shoulder 165 of a lower sleeve 170. A compression ring 166 functions as does the compression ring 162. A hole 167 through the transition member 163 is an epoxy bleed hole and a pin 168 functions as does the pin 161. A hole 169 is for epoxy injection. Recesses 171 and 209 (seen in FIG. 2D) function as the recesses 206, 207 (seen in FIG. 2C).

Set pins 172 (two, three, four or more) hold the sleeve 170 to the packer mandrel 42, which two members may also be epoxied together.

Figure 2E:
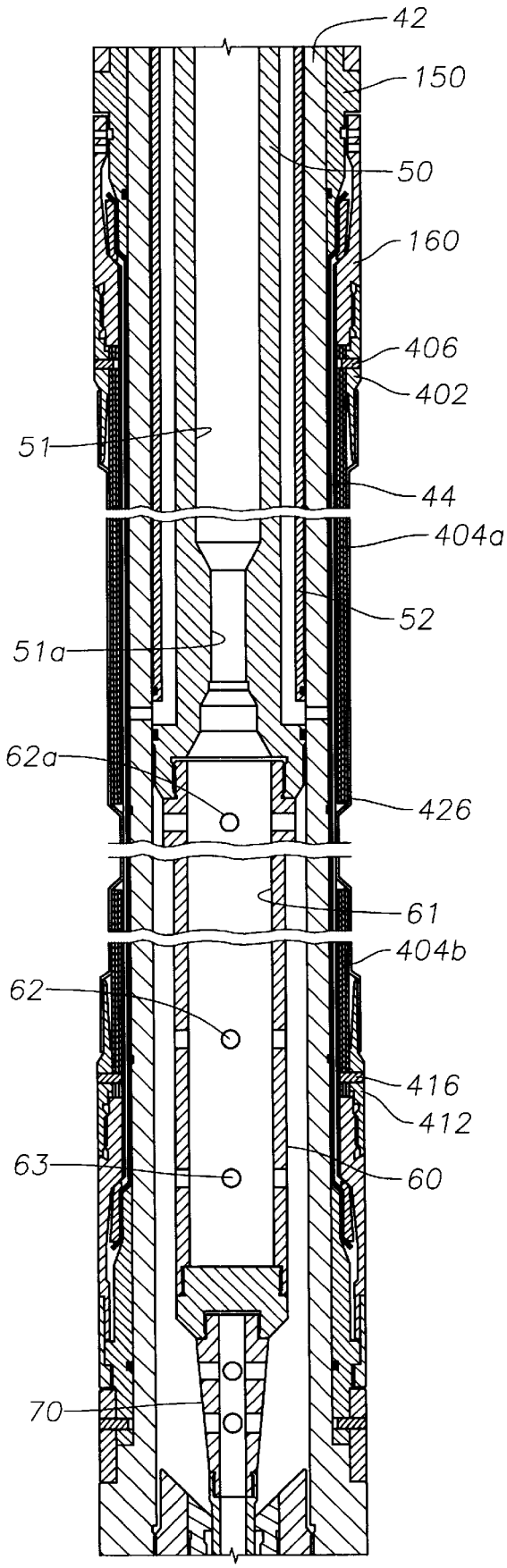
Figure 2F:
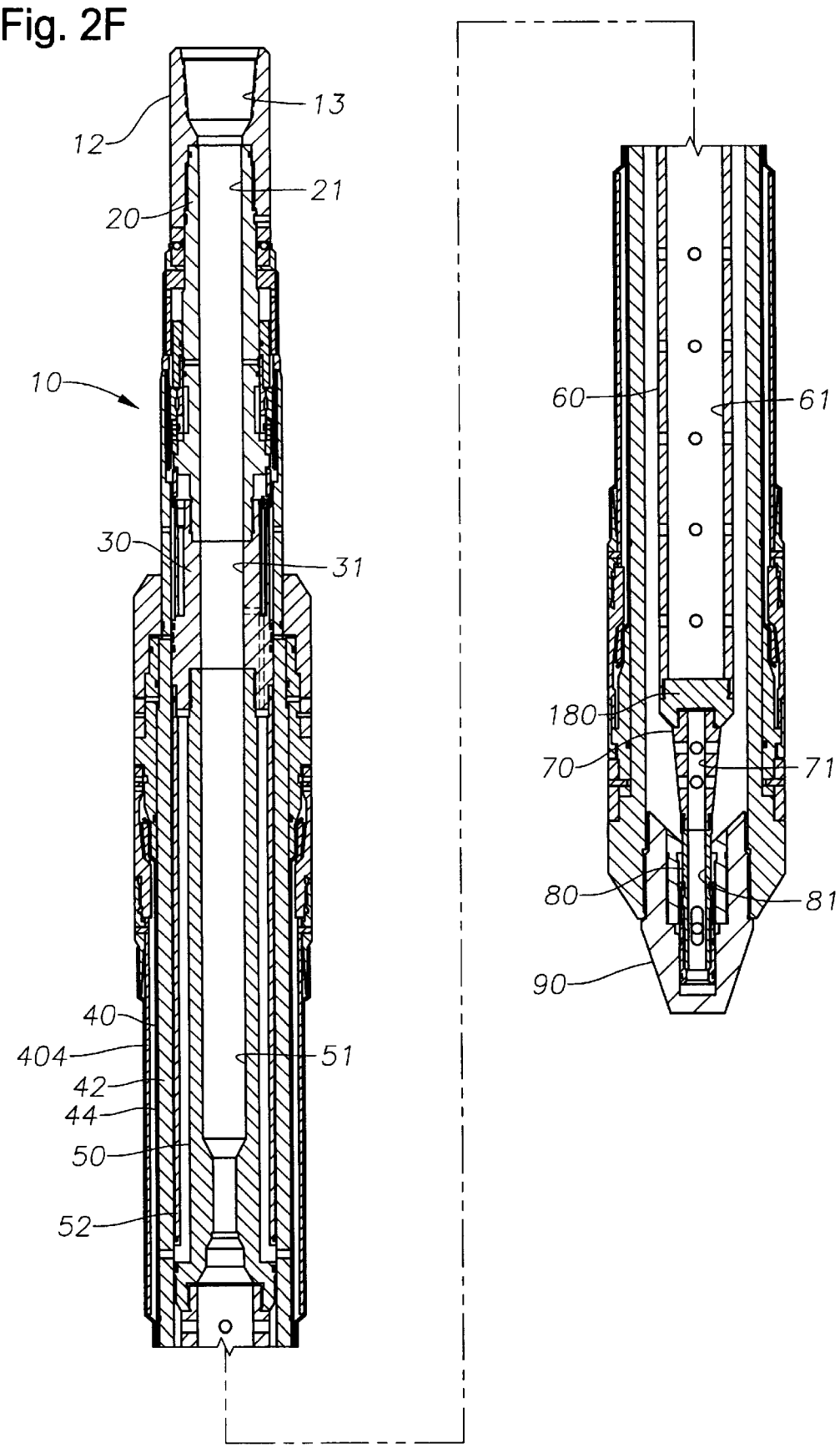
FIG. 2F presents a side cross-section view of a packer system wherein a single set of ribs is employed.

As shown in FIG. 2E, an upper sleeve adapter 402 may be coupled to the transition member 160. The upper sleeve adapter 402 is configured to retain a first set of ribs 404*a* between the upper sleeve adapter 402 and a top portion of the inflatable bladder 44 by screws 406 or by other fastening members or means such as by epoxy. A lower sleeve adapter 412 is configured to retain a second set of ribs 404*b* between the lower sleeve adapter 412 and a bottom portion the inflatable bladder 44 by screws 416 or by other fastening member or means such as by epoxy. In one aspect, the ribs 404*a* and 404*b* may be "discontinuous" along the bladder to allow for greater expansion of the inflatable bladder 344. In another embodiment (not shown), the ribs may be "continuous" along the inflatable bladder 44 in which one set of ribs are retained by both the upper sleeve adapter 402 and the lower sleeve adapter 412.

The ribs 404, whether continuous or discontinuous, may be arranged as one or more layers around the inflatable bladder. The ribs 404 may be arranged around the inflatable bladder 44 in any pattern. In one embodiment, the ribs may be arranged as one to fifty layers around the inflatable bladder. As shown in FIG. 2C and FIG. 2D, the first set of ribs 404*a* and the second set of ribs 404*b* comprise three layers of ribs.

In one embodiment, each layer of ribs comprises a cylindrical sleeve in which slits have been made along a partial length of the sleeve to form the ribs. The base of the cylindrical sleeve may comprise a band of material which may be fastened to the upper sleeve adapter 402 or the lower sleeve adapter 412 by the screws 406 or 416.

In one embodiment, each rib 404 is rectangular in shape. Alternatively, the ribs 404 may be in other shapes or may be in a variety of shapes. For example, the ribs 404 may be in a shape that is at least partially curved, such as shaped like fingers, and/or may be in a shape that is at least partially pointed.

The ribs 404 may comprise any suitable material, e.g., but not limited to metals and metal alloys (steel, bronze, brass, stainless steel, aluminum, copper, tin, and other ferrous and non-ferrous metals); and, in certain aspects, to drillable materials, e.g. but not limited to aluminum, aluminum alloys, zinc, zinc alloys, cast iron, brass, bronze, copper, tin, other non-ferrous metals and non-ferrous metal alloys, fiberglass, PEEK, drillable plastic, PTFE, composite materials, composite-coated fiberglass, resin-coated fiberglass, cermet coated fiberglass and/or fiber reinforced resin materials. Composite materials include fiberglass, polymers, polymer blends, hydrocarbon-based materials and other structural materials, and may include strengthening members, such as glass fibers, carbon fibers, aramid fibers and/or other fibers, embedded in the material. Preferably, the ribs 404 comprise a composite material. In one embodiment, the ribs 404 comprise a composite material in which the ribs have a thickness between about 0.005 inches to about 0.100 inches.

In one embodiment, a flexible material layer 426 may be disposed around the ribs 404 to cover the ribs 404 during run-in. The flexible material layer 426 may comprise any flexible material and preferably comprises a drillable material.

As shown in FIG. 2C, the bore 51 of the dart seat member 50 has a lower portion 51*a* into which a dart pumped from the surface moves to seal off the bore 5110 fluid flow. An O-ring 173 seals a dart sleeve/packer mandrel interface and an O-ring 174 seals a dart seat member/packer mandrel interface. Ports 175 are in fluid communication with a channel 126_defined by the interior of the dart sleeve 52 and the exterior of the dart seat member 50. The channel 126 is in fluid communication with the channel 122 shown in FIG. 2A so that fluid to inflate the bladder 44 is selectively flowable through the bore 31, through the valve assembly 120, through channel 122, through the channel 126, through ports 175, to inflate the bladder 44. Instead of a dart seat member and dart(s), any suitable bore obstructor which permits fluid pressure build-up and pressure control may be used, including, but not limited to ball/seat apparatuses, movable sleeves with alignable ports apparatuses, and/or restricted orifice devices.

As noted above, a dart catcher 60 is provided below the dart seat member 50. The dart catcher 60 has a series of ports 62*a*, 62, and 63 for fluid flow. The dart catcher 60 is sized and the ports 62*a*, 62, 63 are located so that fluid may flow out from it after a dart (or darts) has been pumped from the lower portion 51*a* of the bore 51 into the dart catcher 60.

The plug or crossover 180 is threadedly connected to a lower end of the dart catcher 60 and seals off this end to fluid flow so that fluid flows out the ports 62, 62*a*, 63. An upper end 72 of the flow diverter 70 threadedly engages a lower end of the crossover 180. Series of ports 73, 74 permit fluid flow into the flow diverter 70. A lower end of the flow diverter 70 is threadedly engaged to an upper end of the stinger 80.

The lower valve assembly 90 has a body 95 with a portion threadedly engaging a lower end of the packer mandrel 42. The valve assembly 90 has fluid exit ports 92 (one shown; there are four spaced-apart ports) through which fluid from the surface may flow when ports 83 (one shown, there are three spaced-apart ports) of the stinger 80 is aligned with the port 92 and a sliding sleeve 94 is in the position shown in FIG. 2D in which it does not block fluid flow through the port 92. The ports 92 and/or 83 may have any suitable zig-zag, spiral, oval or other shape to ensure alignment of the ports 92 and 83 for fluid flow. A sliding sleeve mandrel 96 encompasses part of the stinger 80 and part of the sliding sleeve 94 and is threadedly engaged in the body 95. O-ring 93 seals the sliding sleeve/lower body 95 interface. Lower valve assembly 90 and all its parts, (including the sliding sleeve 94 and the sleeve mandrel 96), in certain embodiments, are made of drillable material. In one particular aspects, the mandrel 96 is made of aluminum.

As shown in FIG. 2D, collet fingers 97 of the sliding sleeve 94 have been forced from corresponding collet recesses 88 in the sliding sleeve mandrel 96, freeing the sliding sleeve 94 for downward movement pushed by the stinger 80 to the position of FIG. 2D in which fluid (e.g. but not limited to cement) is flowable out through the port 92 to the space below the system 10 in a wellbore and up the annulus between the system's exterior and the wellbore's interior (or tubular interior if the system 10 is used within a tubular).

As shown in FIG. 2D, the collet fingers 97 are held in recesses 98 in the sliding sleeve mandrel 96 when the sliding sleeve is pushed downward. Upward movement of the stinger 80 will bring slanted shoulder 85 of the stinger 80's exterior into contact with slanted portion 99 of the collet fingers 97, forcing the collet fingers 97 from the recesses 98 and into recesses 86 of the stinger 80. Further upward movement of the stinger 80 will align the collet fingers 97 with recesses 88 of the sliding sleeve mandrel 96 and then move the collet fingers 97 into the recesses 88. In this position the sliding sleeve 94 blocks fluid flow through the port 92 and the sliding sleeve is again releasably held to the sliding sleeve mandrel 96.

In one particular embodiment of a method according to the present invention using a system as described above, the system is run into a borehole (uncased) in the earth and located at a desired location in the borehole below which it is desired to place cement. In one aspect such a location is the location at which control of fluid circulation down the borehole has been lost, known as a lost circulation zone, and the purpose of the method in this aspect is to plug off the lost circulation zone, remove part of the system, leave part of the system cemented in place (e.g. a drillable inflatable packer and lower valve apparatus), and, following adequate setting of the cement, drill or mill ('cut") through the packer and lower valve apparatus to reclaim the bore for further operations, e.g. above and/or below the lost circulation zone e.g., but not limited to, further drilling.

Following location of the system at the desired area in the borehole, a first dart (not shown) is dropped and falls into the dart seat member 50 so that fluid under pressure may be pumped down the borehole to the system at sufficient pressure to shear the pin 127, of the valve assembly 120, thereby opening the valve assembly 120 for fluid flow, e.g. cement, to inflate the inflatable bladder of the packer element. At this time, pressure of the pumped cement also forces the piston 130 down, shearing the shear pins 145 to release the draw sleeve 150 so that part of the packer element is free to move outwardly as it inflates with the cement.

As the inflatable bladder 44 fills with cement, the inflatable bladder expands outward and pushes against the ribs 404 (as shown in FIG. 2E). The ribs 404 bend to allow expansion of the inflatable bladder 44 while providing support for the shape of the inflatable bladder 44. The support provided by the ribs 404 helps prevent extrusion of the inflatable bladder 44 and bursting of the inflatable bladder 44.

Cement pressure builds up on the valve assembly 120 to a level at which the packer element 43 is sufficiently inflated and a closing valve in the valve assembly 120 is activated to close off flow through the valve assembly 120, thereby closing off further flow to the packer element 43. Thus the inflating cement is held in the inflated a element 43.

Further pumping pressure is now applied with fluid (e.g. water or brine) to the system above the first dart to pump it out from the dart seat member 50 into the dart 60. The first dart sits in the dart catcher without blocking the dart catcher's exit catcher ports, e.g., 62*a*. The cement is allowed to set in the packer element 43 so that the packer element 43, packer mandrel 42, lower valve assembly 90, and associated structure can seal off the borehole for further cementing.

Once the cement is set, a second dart is dropped into the dart seal member 50 and fluid under pressure (e.g. at about 3000 psi) is then pumped down to the second dart to a pressure level sufficient to force the piston 28 to move to shear the shear screws 101 that releasably hold the dogs 29. Upon shearing of the shear screws 101, the dogs move inwardly, freeing the running apparatus from the packer apparatus. Then the running tool apparatus (top sub 12, mandrel 20, valve assembly housing 30, dart seat member 50, dart seat sleeve 52, dart catcher 60, and stinger 80) are raised to disengage the running tool apparatus from the packer apparatus (packer mandrel 42, packer element 43, lower valve assembly 90, etc.). The running tool apparatus is raised (e.g. a few feet) to indicate that the running apparatus is disengaged from the packer apparatus. Optionally, if effective disengagement of the running apparatus from the packer apparatus does not occur, then the running apparatus is rotated (e.g. about four times) so that the threads 15 unscrew from the threads 16 to free the running apparatus from the packer apparatus, whether the dogs have moved inwardly or not (e.g. if the dogs 29 do not move, e.g. if debris or other material prevents them from moving).

Once the running apparatus is freed from the packer apparatus and raised, the running apparatus is lowered down again so that flow through the ports 92 is again possible. Then the second dart is pumped through to the dart catcher (e.g. at about 4200 psi). Optionally, at this point a third dart may be dropped followed by cement and then forced through the dart-seat member into the dart catcher. When the third dart seats in the dart seat member it provides positive indication at the surface (e.g. a pressure buildup indicated on a surface gauge) that the cement for the formation plugging step is at a desired location, i.e., that it has reached the borehole area of the packer and lower valve assembly. The third dart also isolates the cement behind it from whatever may be in front of it, including, but not limited to, fluid from the formation, drilling fluids, water, brine, etc.

Cement pumping now continues out through the ports 92. In certain aspects a pre-determined volume of cement is pumped and allowed to set. In other aspects, cement is pumped until a pressure build-up is indicated at the surface, indicating that the formation is being successfully plugged off. Upon the cessation of cement pumping, the running apparatus is raised, bringing the collet fingers 97 up to snap into the recesses 88 in the lower valve mandrel 96, thereby closing off the ports 92 to further flow. Optionally, additional cement may be pumped on top of the lower valve apparatus 90 and adjacent the packer element 43 as the running apparatus is raised. The running apparatus is then removed to the-surface.

After the cement is set, and the borehole is effectively sealed off to fluid flow, operations may be conducted above the area of cementing and/or the borehole may be reclaimed for further operations, e.g. but not limited to, further drilling below the lost circulation zone by drilling or milling through the inflated packer and its lower valve apparatus, related structure, and cement. For this reason, in certain preferred embodiments, the inflated packer and lower valve apparatus and related structure remaining in the borehole following removal of the running apparatus is made of relatively easily drillable and/or millable material. In one embodiment, the packer comprises a plurality of ribs made of a drillable material. In another embodiment, the packer comprises a plurality of ribs made of a composite material. The ribs comprising a drillable material or a composite material may be easily drilled or milled into smaller pieces. These pieces may be circulated up the annulus and out of the wellbore with a fluid, such as the fluids used during drilling and/or milling. If cement has channeled through the formation to an area above the packer and then back into the borehole, it too can be drilled or milled.

The present invention, therefore, discloses in certain, but not necessarily all, embodiments a packer system with an inflatable packer having a packer body, the packer body having a fluid flow bore therethrough, an inflatable bladder mounted around the packer body, a bladder support mounted around the inflatable bladder, and a plurality of ribs mounted around the inflatable bladder. The packer body, the inflatable bladder, the bladder support, and the ribs may be made of drillable material. The packer system may further include a valve apparatus connected with the packer body and in fluid communication with the fluid flow bore of the packer body for selectively controlling fluid flow from the packer to a space outside the packer system, and the valve apparatus made of drillable material.

The present invention, therefore, discloses in certain, but not necessarily all, embodiments a system for installing an inflatable packer in a bore, the system including running apparatus, an inflatable packer releasably connected to the running apparatus, the inflatable packer comprising a packer body, the packer body having a fluid flow bore therethrough, an inflatable bladder mounted around the packer body, a bladder support mounted around the inflatable bladder, and a plurality of ribs mounted around the inflatable bladder. The packer body, the inflatable bladder the bladder support, and the ribs may be made of drillable material. The system may further include a valve apparatus connected with the packer body and in fluid communication with the fluid flow bore of the packer body for selectively controlling fluid flow from the packer to a space outside the packer system, and the valve apparatus made of drillable material, and the running apparatus selectively releasable from the inflatable packer following setting of the inflatable packer in the bore. Such a system may have one, some, or all of the following: wherein dual separation means are provided interconnecting the running apparatus and the inflatable packer, activation of either separation means alone for effecting separation of the running apparatus from the inflatable packer; fluid flow means for controllably flowing fluid through the running apparatus, through the inflatable packer and its valve apparatus, and out from the system into the bore below the system; and/or the valve apparatus including selectively controllable apparatus for selectively permitting fluid flow out from the valve apparatus into the bore below the system, the running apparatus's fluid flow means including activation apparatus for selectively co-acting with the selectively controllable apparatus of the valve apparatus to shut off fluid flow through the valve apparatus upon removal of the running apparatus from the inflatable packer.

The present invention, therefore, discloses in certain, but not necessarily all, embodiments a method for installing a packer in a bore, the method including positioning a packer at a desired location in a bore, the packer comprising a packer body, an inflatable bladder mounted around the packer body, a bladder support mounted around the inflatable bladder, and a plurality of ribs mounted around the inflatable bladder. The packer body, the inflatable bladder, the bladder support, and the ribs may be made of drillable material, and inflating the inflatable bladder to set the packer at the desired location in the bore. Such a method may include one, some or all of the following: cutting through the packer to gain access to the bore; wherein the packer is cut through with drilling apparatus, milling apparatus, or milling-drilling apparatus; wherein the packer has valve apparatus connected thereto or to the packer body and in fluid communication with the fluid flow bore of the packer body for selectively controlling fluid flow from the packer to a space outside the packer system, the method including selectively flowing fluid through the packer and through the valve apparatus; wherein the valve apparatus is made of drillable material; wherein the bore is a wellbore or a bore in a tubular of a tubular string in a wellbore; wherein the bore is a bore through a tubular and the packer is located at a desired location in the tubular; wherein the fluid is cement or water, brine, or drilling fluid; flowing the cement into an annular space between the packer and an interior wall of the bore and flowing cement to a space below the valve apparatus; flowing the cement into a lost circulation zone to plug it off; and/or cutting through the packer and through the valve apparatus with either drilling apparatus or milling apparatus to regain access to the bore.

The present invention, therefore, discloses in certain, but not necessarily all, embodiments a method for reclaiming a borehole extending from an earth surface into the earth, part of which borehole is in a lost circulation zone, the method including closing off the borehole to fluid flow above the lost circulation zone by installing a packer system with an inflatable packer element and a valve apparatus in the borehole above the lost circulation zone, the packer system made of drillable material, inflating the inflatable packer element with cement, and allowing the cement to set so that the inflatable packer and the valve apparatus effectively seal off the borehole to fluid flow. Such a method also including a further operation conducted in the borehole above the lost circulation zone; and/or cutting through the inflatable packer, cement, and valve apparatus to open the borehole for further operations below the lost circulation zone.

The packer of the present invention comprising ribs, such as ribs made of a drillable material or made of a composite material, may also be used in any application in which an inflatable packer is used or in any application that requires a packer that cannot be retrieved. For example, the packer may be used as a drillable bridge plug.

Furthermore, the packer of the present invention may include other components well-known in the art. For example, the packer of the present invention may include a set assembly which independently retains the packer in the wellbore. For example, set assemblies, which are well-known in the art, typically include slips with teeth thereon and cones. In one aspect, the set assembly is made of a drillable material.

While foregoing is directed to the preferred embodiment of the present invention, other and further embodiments of the invention may be devised without departing from the basic scope thereof, and the scope thereof is determined by the claims that follow.

What is claimed is:

1. An inflatable packer, comprising:

a packer body;

an inflatable bladder mounted around the packer body;

a plurality of ribs at least partially mounted around the inflatable bladder, each of the ribs having a thickness between about 0.005 inches to about 0.100 inches; and the packer body, the inflatable bladder, and the ribs being composed of a drillable material.

2. The inflatable packer of claim 1, wherein the plurality of ribs comprises a first set of ribs mounted around a top portion of the inflatable bladder and a second set of ribs mounted around a bottom portion of the inflatable bladder.

3. The inflatable packer of claim 2, wherein the first set and the second set of ribs each comprises one or more layers of ribs.

4. The inflatable packer of claim 3, wherein each of the one or more layers of ribs is at least partially offset from an adjacent layer of ribs.

5. The inflatable packer of claim 3, wherein each of the one or more layers of ribs includes a cylindrical sleeve having slits along a partial length of the cylindrical sleeve.

6. The inflatable packer of claim 1, wherein the plurality of ribs comprises one set of ribs mounted around a top portion and a bottom portion of the inflatable bladder.

7. The inflatable packer of claim 6, wherein the set of ribs comprises one or more layers of ribs.

8. The inflatable packer of claim 7, wherein the set of ribs comprises a plurality of layers of ribs.

9. The inflatable packer of claim 8, wherein each layer of ribs is at least partially offset from an adjacent layer of ribs.

10. The inflatable packer of claim 9, wherein each layer of ribs comprises a cylindrical sleeve having slits along a partial length of the cylindrical sleeve.

11. The inflatable packer of claim 1, wherein the plurality of ribs is composed of a composite material.

12. The inflatable packer of claim 1, wherein the plurality of ribs comprises a drillable metal or drillable metal alloy.

13. The inflatable packer of claim 12, wherein the drillable metal or drillable metal alloy is selected from the group consisting of aluminum, aluminum alloys, zinc, zinc alloys, cast iron, brass, bronze, copper, and tin.

14. The inflatable packer of claim 1, further comprising a movable member connected to the packer body and to the inflatable bladder, the movable member movable with respect to the packer body to accommodate expansion of the inflatable bladder.

15. The inflatable packer of claim 1, further comprising a flexible material layer covering the plurality of ribs.

16. The inflatable packer of claim 1, wherein the inflatable packer further comprises a packer support, the packer support being coaxially disposed around the inflatable bladder, and the packer support also being fabricated from a drillable material.

17. An inflatable packer, comprising:

a packer body;

an inflatable bladder mounted around the packer body;

a first set of layers of ribs mounted around a top portion of the inflatable bladder;

a second set of layers of ribs mounted around a bottom portion of the inflatable bladder; and the ribs composed of a composite material, and each of the ribs having a thickness between about 0.005 inches to about 0.100 inches.

18. The inflatable packer of claim 17, wherein the packer body and the inflatable bladder comprises a drillable material.

19. A system for installing an inflatable packer in a bore, the system comprising:

a running apparatus; and an inflatable packer releasably connected to the running apparatus and adapted to be selectively releasable from the running apparatus following setting of the inflatable bladder in the bore, the inflatable packer comprising:

a packer body, the packer body having a fluid flow bore therethrough, an inflatable bladder mounted around the packer body, a plurality of ribs mounted around the inflatable bladder, each of the ribs having a thickness between about 0.005 inches to about 0.100 inches;

a valve apparatus connected with the packer body and in fluid communication with the fluid flow bore of the packer body for selectively controlling fluid flow from the packer to a space outside the packer system, and the inflatable bladder, the packer body, the ribs, and the valve apparatus made of drillable material.

20. A method for installing a packer in a bore, the method comprising:

positioning a packer at a desired location in a bore, the packer comprising a packer body, an inflatable bladder mounted around the packer body, a plurality of ribs mounted around the inflatable bladder, each of the ribs having a thickness between about 0.005 inches to about 0.100 inches;

the packer body, the inflatable bladder and the ribs made of drillable material, and inflating the inflatable bladder to set the packer at the desired location in the bore.

21. The method of claim 20, further comprising:

cutting through the packer to gain access to the bore.

22. A method for reclaiming a borehole extending from an earth surface into the earth, part of which borehole is in a lost circulation zone, the method comprising closing off the borehole to fluid flow above the lost circulation zone by installing a packer system with an inflatable packer element, a plurality of ribs disposed around the inflatable packer element, and a valve apparatus in the borehole above the lost circulation zone, the packer system made of drillable material, and the ribs having a thickness between about 0.005 inches to about 0.100 inches; and inflating the inflatable packer element with cement, and allowing the cement to set so that the inflatable packer element and the valve apparatus effectively seal off the borehole to fluid flow.

23. The method of claim 22, wherein a further operation is conducted in the borehole above the lost circulation zone.

24. The method of claim 22, further comprising cutting through the inflatable packer element, cement, the ribs, and valve apparatus to open the borehole for further operations below the lost circulation zone.

* * * * *